US008495967B2

(12) United States Patent
Williams et al.

(10) Patent No.: US 8,495,967 B2
(45) Date of Patent: Jul. 30, 2013

(54) WAKEBOARD TOWER WITH BIMINI COVER AND SKI TOW POINT

(75) Inventors: Anthony Duane Williams, Maryville, TN (US); Robert Blaine Metcalf, Lenoir City, TN (US)

(73) Assignee: Xtreme Marine Corporation, Maryville, TN (US)

( * ) Notice: Subject to any disclaimer, the term of this patent is extended or adjusted under 35 U.S.C. 154(b) by 167 days.

(21) Appl. No.: 13/228,033

(22) Filed: Sep. 8, 2011

(65) Prior Publication Data

US 2012/0067269 A1 Mar. 22, 2012

Related U.S. Application Data

(60) Provisional application No. 61/383,516, filed on Sep. 16, 2010.

(51) Int. Cl.
*B63B 17/02* (2006.01)

(52) U.S. Cl.
USPC ..... 114/361; 114/253

(58) Field of Classification Search
USPC ..... 114/253, 361, 343, 364; 135/88.01
See application file for complete search history.

(56) References Cited

U.S. PATENT DOCUMENTS

| | | | | |
|---|---|---|---|---|
| 5,918,613 | A | 7/1999 | Larson | |
| 6,257,261 | B1 | 7/2001 | Johnson | |
| 6,691,637 | B1 | 2/2004 | Smith | |
| 6,945,188 | B2 | 9/2005 | Eck | |
| 6,994,050 | B2 | 2/2006 | Johnson | |
| 7,392,758 | B2 * | 7/2008 | Metcalf | 114/361 |
| 2002/0053313 | A1 | 5/2002 | Murphy | |
| 2005/0186029 | A1 | 8/2005 | Jones | |
| 2007/0290016 | A1 | 12/2007 | Jesewitz | |

* cited by examiner

*Primary Examiner* — Lars A Olson
(74) *Attorney, Agent, or Firm* — Luedeka Neely Group, P.C.

(57) ABSTRACT

A wakeboard tower having an elevated tow point and a bimini or other sun cover integrated to the tower in a manner that does not interfere with the tow point.

6 Claims, 7 Drawing Sheets

WAKEBOARD TOWER WITH BIMINI COVER AND SKI TOW POINT

CROSS-REFERENCE TO RELATED APPLICATION

This application claims priority to U.S. Provisional Application Ser. No. 61/383,516 filed Sep. 16, 2010, and entitled "Wakeboard Tower With Bimini Cover And Ski Tow Point," incorporated by reference herein in its entirety.

FIELD

The present disclosure relates to wakeboard towers for boats. More particularly, the disclosure relates to a wakeboard tower constructed to include a tow point and a bimini cover that does not interfere with the tow point, and to such a tower of folding construction.

BACKGROUND AND SUMMARY

The sport of wakeboarding is very similar to the sports of waterskiing, kneeboarding, and tubing. A wakeboarder or person riding a wakeboard is towed behind the boat by a rope. Typically, waterskiing, kneeboarding, and tubing use a rope secured to a stern mount on either or both sides of the motor of the boat. However, in the sport of wakeboarding, the rope is typically attached to a mount connected to a tower cross member. The mount on the tower provides a much higher connection point for the tow rope and provides vertical component force on the tow rope held by a wakeboarder thus allowing the wakeboarder to more easily perform aerial stunts and maneuvers. That is, the wakeboarding experience is improved by use of a tow point that is elevated as compared to the elevation of tow points used for waterskiing.

The provision of a tower having an elevated tow point interferes with the use of conventional bimini covers of the type used on boats having a low tow point. Attempts have been made to incorporate bimini or other sun-shielding covers with wakeboard towers having an elevated tow point. Such covers are not integrated with the tower and are useable at times when the boat is not in use to pull a wakeboarder. However, as the covers can interfere with the elevated tow point of the wakeboard tower, they are generally unsuitable for use when the tow point is in use. This results in undesired sun exposure and other undesirable circumstances resulting from the lack of a cover while the boat is in use to pull a wakeboarder. Accordingly, what is desired is an improved wakeboard tower having a tow point and a bimini cover that does not interfere with the tow point.

The disclosure advantageously provides a wakeboard tower constructed to include a tow point and a bimini cover that does not interfere with the tow point, and to such a tower of folding construction.

In one aspect, the wakeboard tower includes an elevated tower having a rear edge, a sun cover integrated with the tower and located above the tower, a tow point extending upwardly from the tower at a rearmost portion of the rear edge and elevated above the tower.

The cover is positioned so as to not interfere with the tow point so that the cover may be used when pulling a wakeboarder and the cover does not interfere with a tow rope attached to the tow point.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
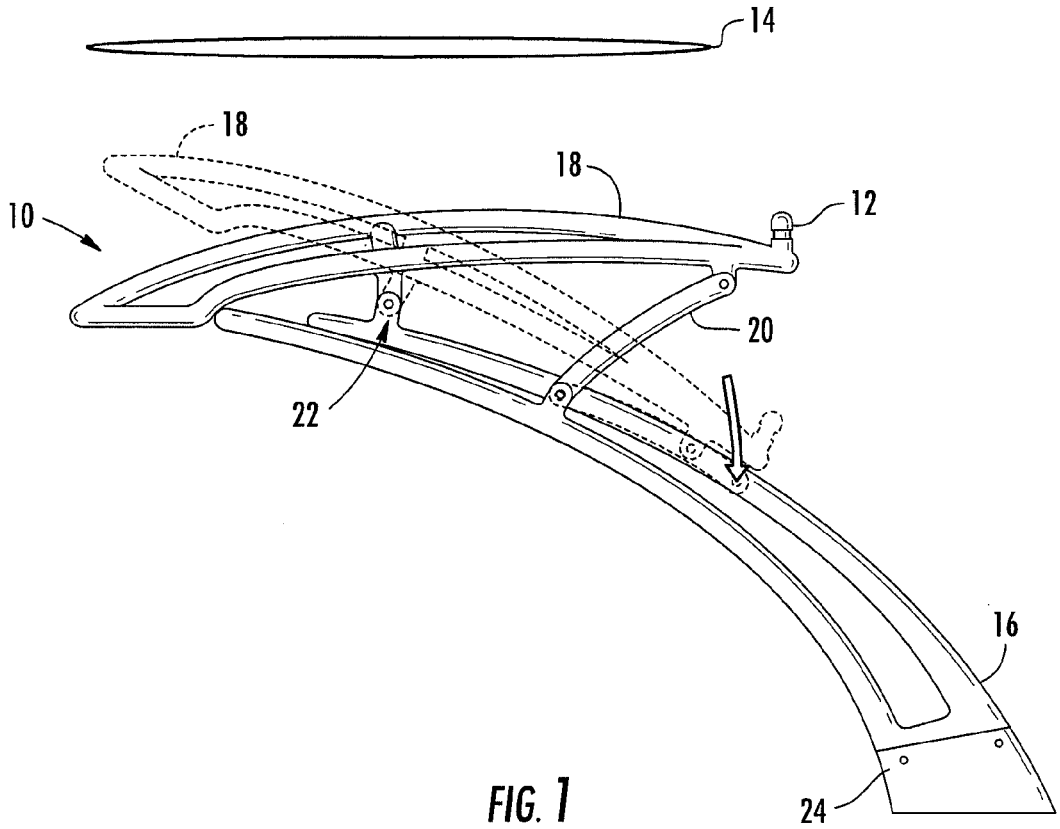
FIG. 1 is a sideview of a wakeboard tower according to the disclosure.

With reference to the drawings, there is shown a wakeboard tower 10 for a boat and configured according to the disclosure to include an elevated tow point 12 and a bimini or other sun cover 14 integrated to the tower 10 in a manner that does not interfere with the tow point 12 aligned with a centerline C of the boat. It will be appreciated that various conventional wakeboard tower accessories, such as speakers S, racks, mirrors, and lights may be attached onto the tower 10, and the cover 14.

The tower 10 may be made in a fixed configuration, or, advantageously may be of folding construction so as to be compactable to facilitate transportation and storage of a boat having the tower 10 installed thereon.

To provide a folding structure, the tower 10 includes a pair of support tower legs 16, a top section 18, a pair of pivoting support arms 20, and a pair of pivot connections 22. It will be appreciated that if the tower 10 is constructed so as to not be folding, then the support arms 20 and the connections 22 may be provided by static members that connect the top section 18 to the support tower legs 16, such as by welding or other suitable methods.

The support tower legs 16 are made of aluminum tubing and generally configured in the shape of an arch mountable to a boat hull so as to extend in a forward or bow direction, rising along its length. If desired, support tower pivot points 24 may be provided on support tower base members about which the support tower legs 16 may pivot so that the tower 10 may be selectively collapsed or folded down for facilitating transport and storage of the boat.

In one embodiment, the top section 18 is generally a concave lattice of sections of aluminum tubing welded together to provide a unitary structure that fans out from a rear edge 26 to a wider front edge 28. The tow point 12 is centrally located at the rearmost portion of the rear edge 26, and situated to extend upwardly there from.

Figure 2:
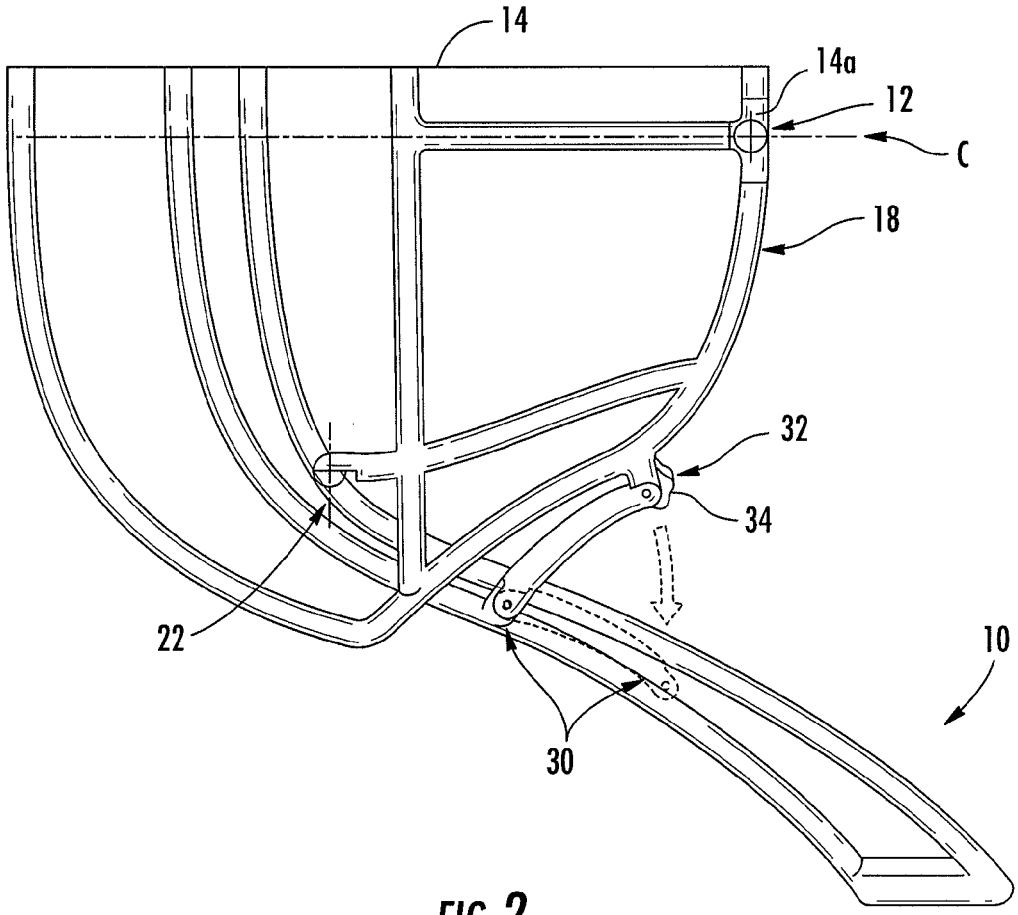
FIG. 2 is a top plan view of the tower of FIG. 1.
Figure 3:
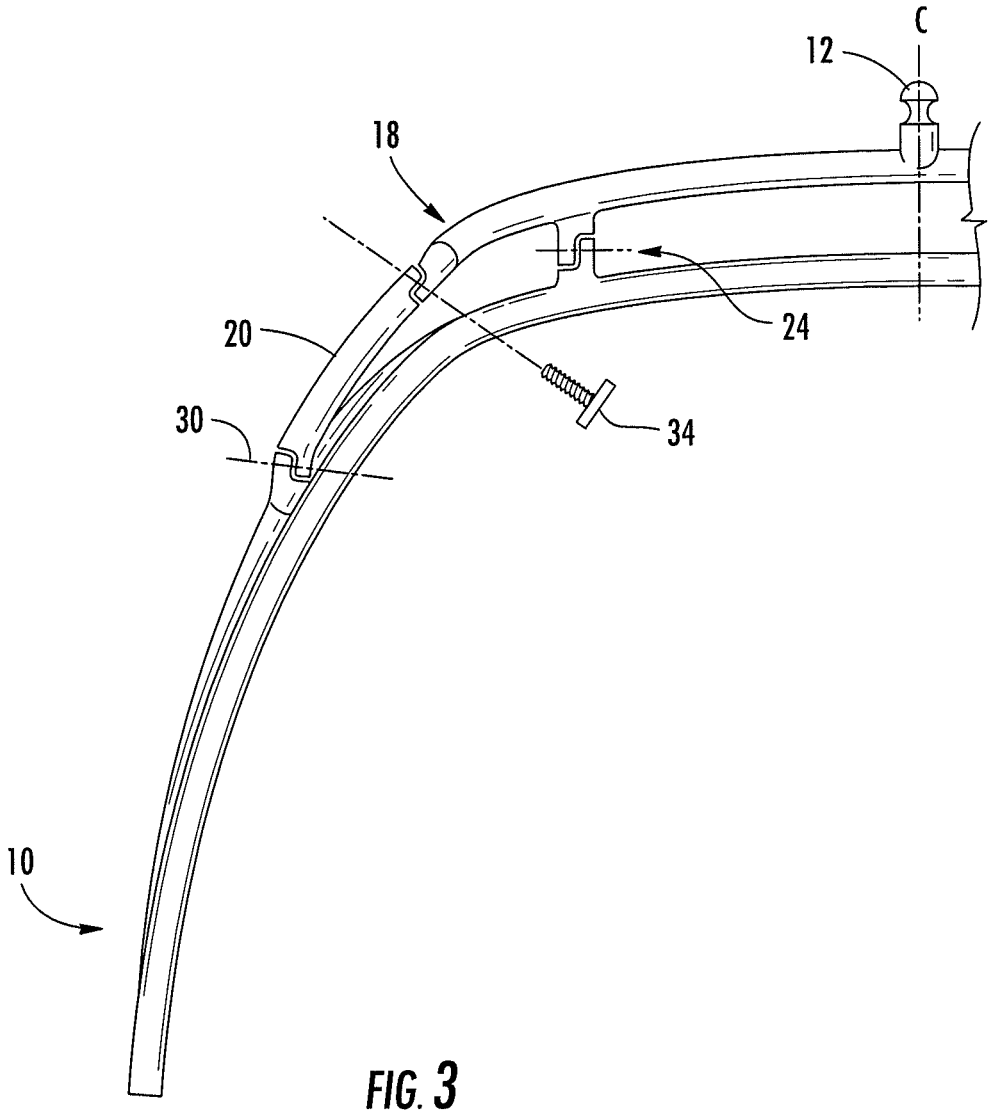
FIG. 3 is a rear plan view of the tower of FIG. 1.
Figure 4:
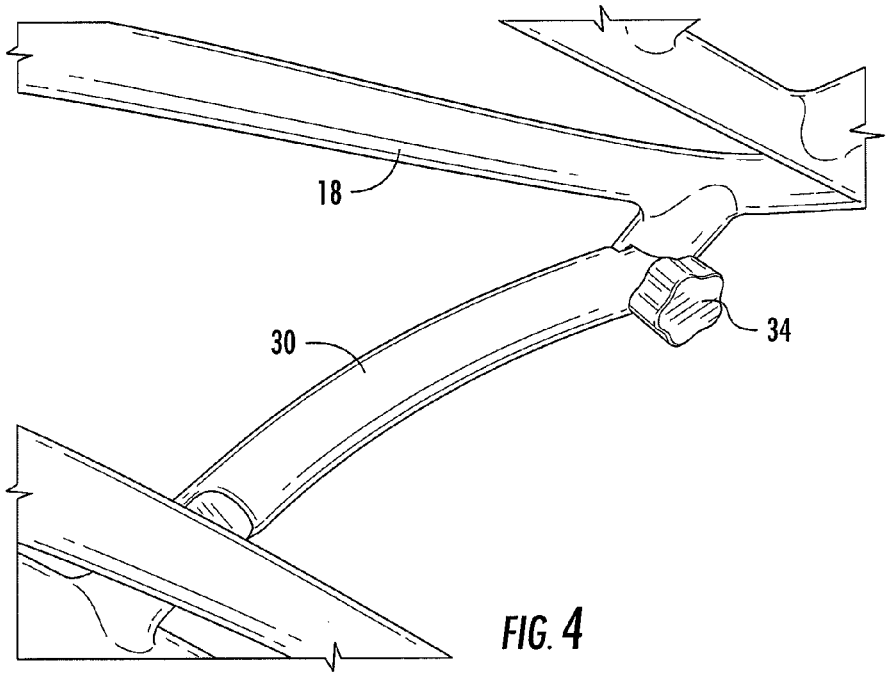
FIGS. 4-10 show a wakeboard tower according to the disclosure, absent a bimini cover.
Figure 5:
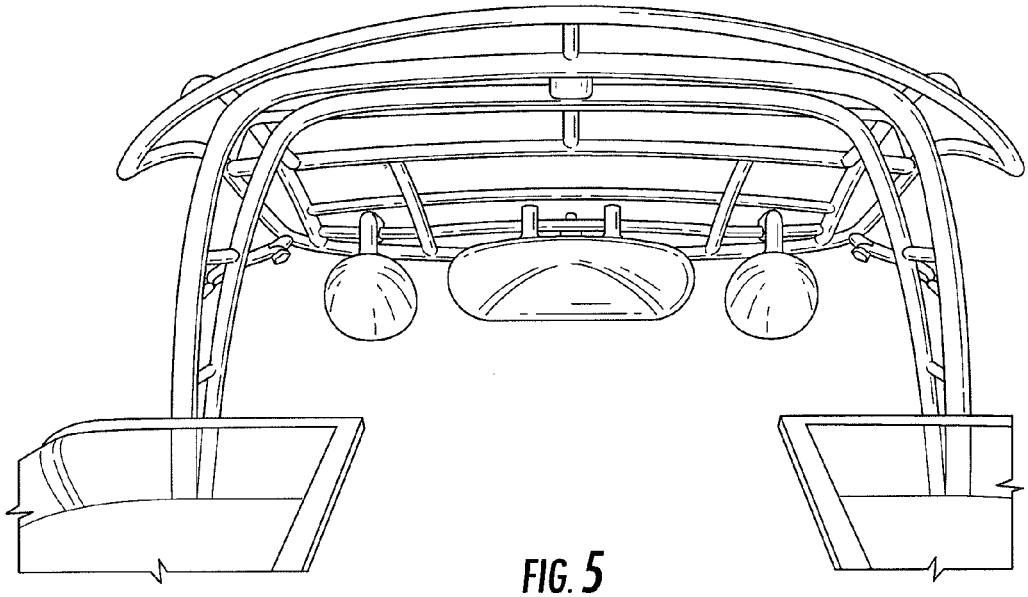
Figure 6:
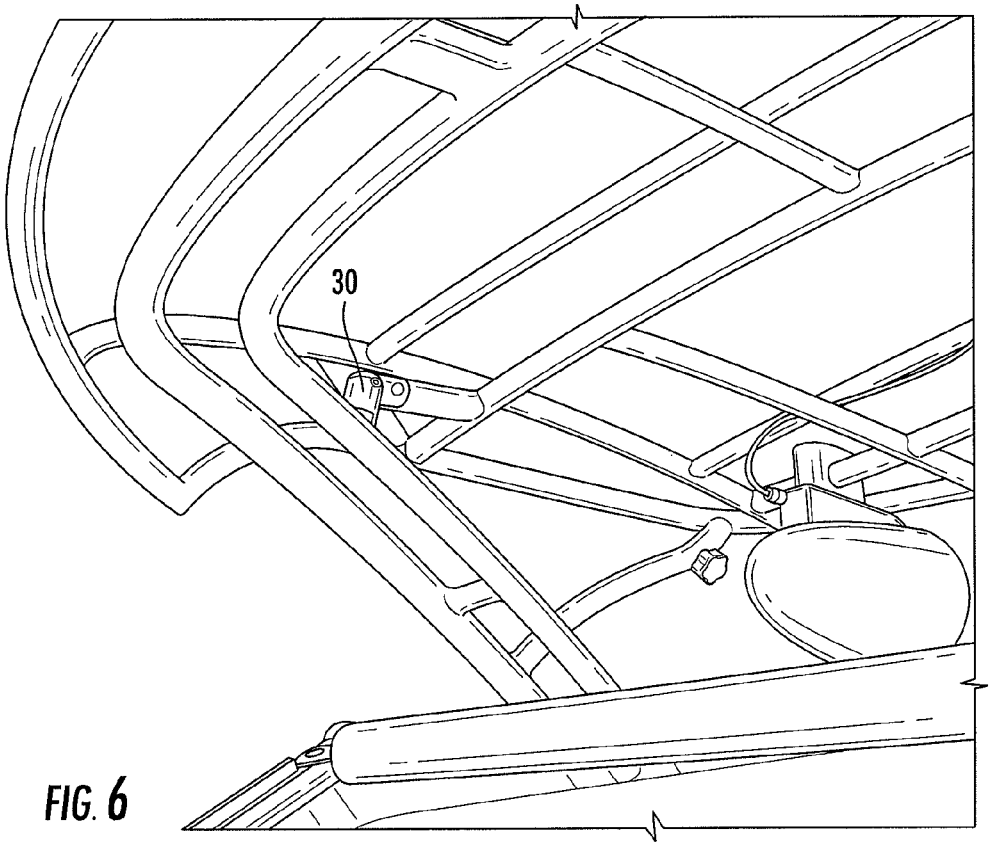
Figure 7:
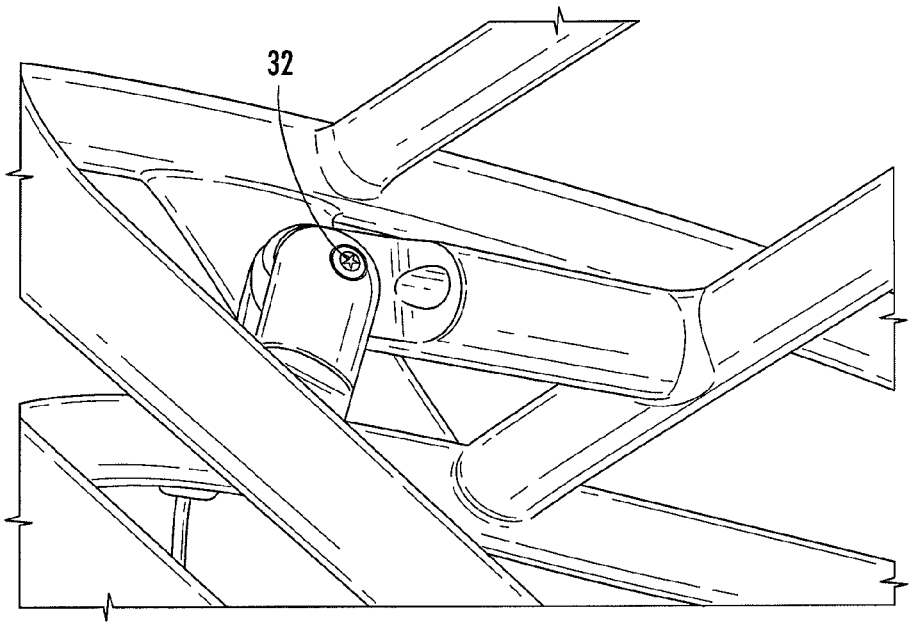
Figure 8:
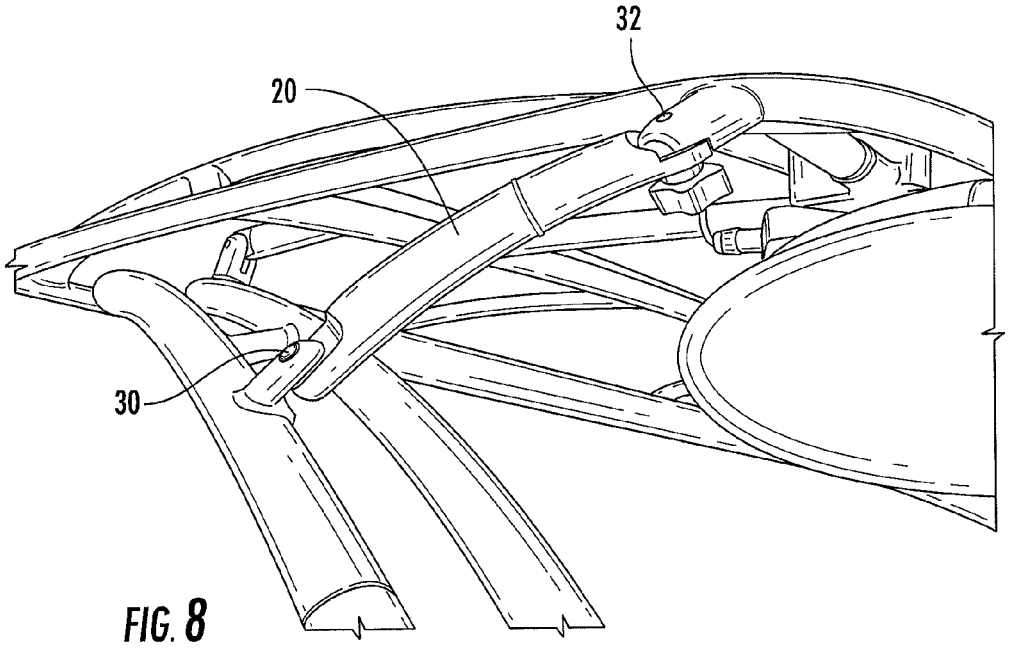
Figure 9:
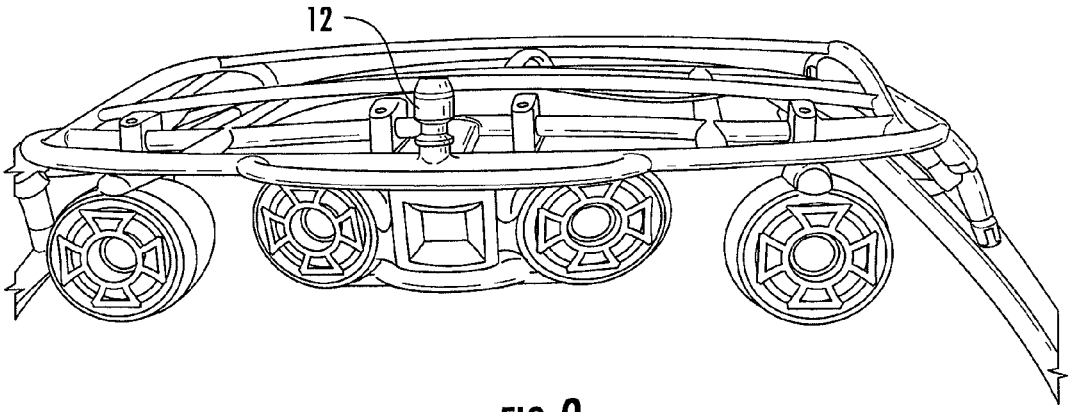
Figure 10:
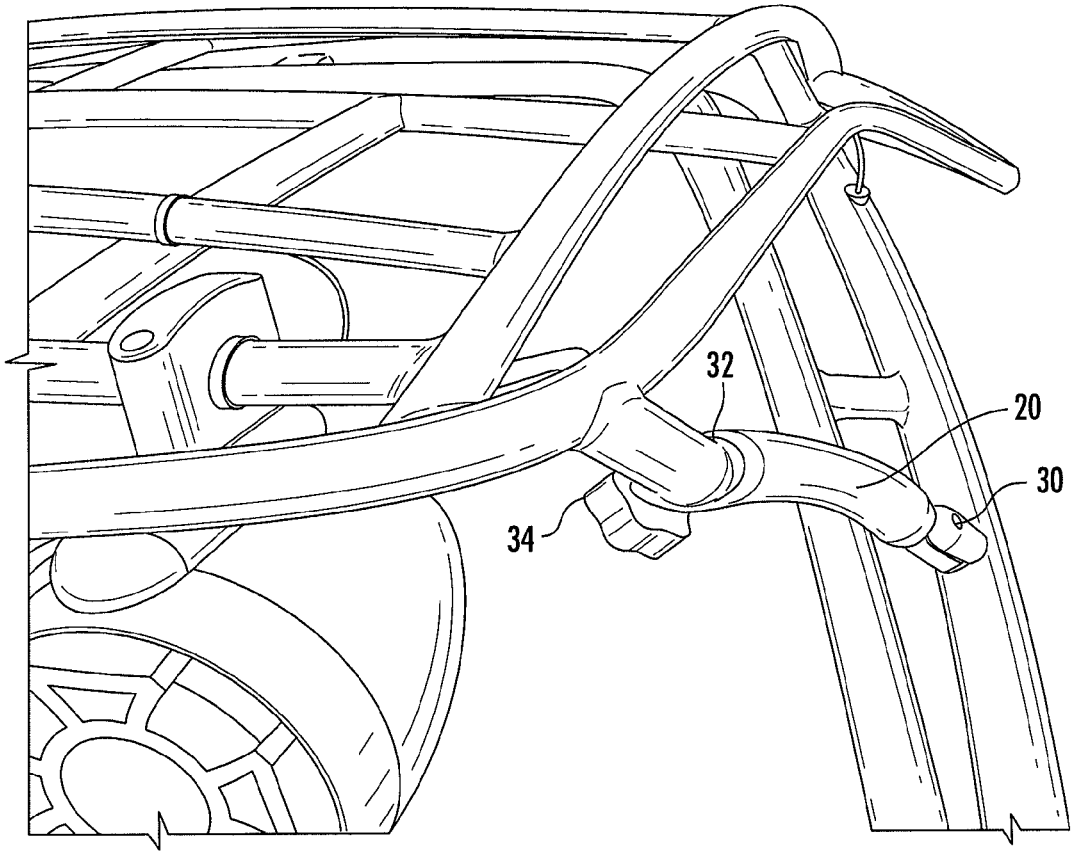

The cover 14 is provided as a flexible fabric material dimensioned to conform to an upper surface of the top section 18, with a cutout portion 14*a* or other configurations so as to fit around the location of the tow point 12 (FIG. 2). The cover 14 is generally of a bimini or open-front style and may be secured to the top section 18 as by straps or snap fasteners or the like so that the cover 14 fits tightly and securely over the top section 18. In this regard, it will be appreciated that the tight fit of the cover 14 over the top section 18, in conjunction the fan shape of the top section 18 and the location of the tow point 12 to extend upwardly at the rearmost portion of the rear edge 26 results in isolation of the cover 14 from contact with a rope attached to the tow point 12, even when a wakeboarder extends wide to the sides of the boat when being towed. Thus, the described structure of the tower 10 advantageously enables provision of a tower having a tow point and a bimini cover that does not interfere with the tow point.

While the tower 10 is advantageous as a fixed configuration structure, it is further advantageous to enable the tower 10 to be folded. In this regard, the pivoting support arms 20 may be provided as lengths of aluminum tubing having a pivot end connection at each end, such as a first pivot connection 30 to the support tower 16, and a second pivot connection 32 to the top section 18. The first pivot connection 30 may be a hinge pin connection and the second pivot connection may be provided as by a threadable pin 34 which may be removed to release the top section 18 so that the support arm 20 may be folded down. In this regard, it will be appreciated that various other types of fasteners may be utilized to provide the pivot connections.

The pivot connections 22 cooperate with the pivoting support arms 20 to provide the overall foldable structure. The pivot connections 22 may be provided as by a simple hinge connection between the support tower legs 16 and the top section 18. The described structure enables the top section 18 to be folded or lowered as shown in phantom in FIG. 1.

Accordingly, it will be appreciated that the tower 10 according to the disclosure advantageously provides a tower having an elevated tow point and a cover that does not interfere with the tow point. The disclosure also enables such a tower further advantageously configured to enable folding or compaction of the tower to facilitate transportation and storage of a boat equipped with the tower.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

The invention claimed is:

1. A wakeboard tower, comprising: an elevated tower comprising at least two legs and a cross member bridging an upper portion of the two legs, a sun cover integrated with the tower and at least partially extending rearwardly from the cross member, wherein the sun cover comprises a bimini cover, a tow point extending upwardly from the sun cover at a portion, wherein the sun cover is positioned so as to not interfere with the tow point so that the cover may be used when pulling a wakeboarder and the cover does not interfere with a tow rope attached to the tow point.

2. The wakeboard tower of claim 1, wherein the tower is foldable.

3. A wakeboard tower, comprising: an elevated tower, a sun cover movably attached to the tower by connectors extending substantially upwardly from a top portion of the tower, a tow point extending upwardly from the sun cover, wherein the sun cover is positioned so as to not interfere with the tow point so that the cover may be used when pulling a wakeboarder and the cover does not interfere with a tow rope attached to the tow point.

4. The wakeboard tower of claim 3, wherein the tower is foldable.

5. The wakeboard tower of claim 3, wherein the sun cover comprises a bimini cover.

6. A wakeboard tower, comprising: an elevated tower comprising at least two legs and a cross member fixedly attached to the two legs and bridging an upper portion of the two legs, a top section with a sun cover attached thereto, the top section extending substantially rearwardly from the cross member and movable in relation to the cross member, and a tow point extending upwardly from a rear edge of the top section, wherein the sun cover is positioned so as to not interfere with the tow point so that the cover may be used when pulling a wakeboarder and the cover does not interfere with a tow rope attached to the tow point.

* * * * *